United States Patent [19]

Schnell

[11] 4,076,081

[45] Feb. 28, 1978

[54] PILE DRIVING DEVICE

[75] Inventor: Hans Gunther Schnell, Hamburg, Germany

[73] Assignee: Van Kooten B.V., Naarden, Netherlands

[21] Appl. No.: 637,987

[22] Filed: Dec. 5, 1975

[30] Foreign Application Priority Data

Dec. 10, 1974 Netherlands ..... 7416079

[51] Int. Cl.[2] ..... E02D 7/12

[52] U.S. Cl. ..... 173/137; 173/124; 173/132; 173/133

[58] Field of Search ..... 173/135, 134, 137, 128, 173/131, 132, 124; 123/46 SC, 46 H, 46 R

[56] References Cited

U.S. PATENT DOCUMENTS

| | | | |
|---|---|---|---|
| 2,633,832 | 4/1953 | Spurlin | 173/137 X |
| 2,882,690 | 4/1959 | Frederick | 173/124 |
| 2,948,122 | 8/1960 | Smith | 173/137 X |
| 3,401,755 | 9/1968 | Frederick | 173/137 X |
| 3,552,501 | 1/1971 | Weiss | 173/124 X |
| 3,934,656 | 1/1976 | Pappert | 173/132 X |

*Primary Examiner*—Ernest R. Purser
*Assistant Examiner*—William F. Pate, III
*Attorney, Agent, or Firm*—Lewis H. Eslinger

[57] ABSTRACT

A pile driving device comprises one or more guide stays, a Diesel hammer, consisting of a combustion cylinder guided by guide means along each guide stay and a hammer piston operating in said combustion cylinder.

Lifting the hammer piston at the start of the known pile-driving device takes place by means of a cable of a winch arranged at a large distance. In order to facilitate the starting the hammer piston is lifted by means of a hydraulic cylinder-piston set which via a catch engages the piston on the one hand and the combustion cylinder on the other hand.

8 Claims, 8 Drawing Figures

PILE DRIVING DEVICE

Figure 1:
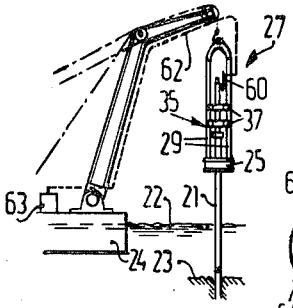

The invention relates to a pile-driving device comprising at least one guide stay, a Diesel hammer consisting of a combustion cylinder guided by guide means along said guide stay, of a hammer piston operating in said combustion cylinder and a striker extending into the combustion cylinder and a lifting device for elevating the hammer piston, said lifting device comprising at least one support, a catch carried by said support and engaging the piston and elevating means lifting said support.

Such a pile-driving device is known. The catch serves to lift the hammer piston at the start of the Diesel hammer. In the known pile-driving device the support is guided along a guide stay when it is lifted by means of a cable which is connected with a winch arranged at a distance, for example, on a floating derrick. Starting this pile-driving device is not an easy task. Moreover, disturbances are frequent since the catch of the support does not engage the point of application of the hammer piston in the correct direction because the support is guided with respect to the guide stay, it is true, but it is only indirectly guided with respect to the hammer piston. Moreover, the hammer piston of the known pile-driving device tends to deflect with respect to the combustion cylinder due to the unilateral engagement of the lifting device with the hammer piston.

The invention has in the first place for its object to facilitate the control of the pile-driving device. For this purpose the lifting means comprise at least one hydraulic cylinder-piston set, which is conected on the one hand with the support and on the other hand with the combustion cylinder.

The cylinder-piston set preferably engages the guide means which guide the combustion cylinder with respect to at least one guide stay. In this case the cylinder-piston set can be connected with the combustion cylinder in a readily exchangeable manner.

If the guide means are formed by a ring surrounding the combustion cylinder, a disturbance-free engagement of each catch with the hammer piston is ensured.

Preferably a plurality of catches engages the hammer piston at areas distributed along the circumference. In this case deflection of the hammer piston relative to the combustion cylinder is avoided.

The invention will now be explained in the following description with reference to a drawing.

Figure 4:
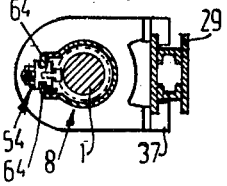
Figure 7:
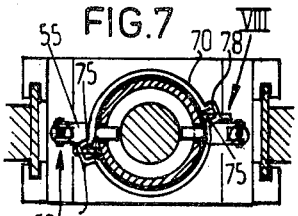
Figure 5:
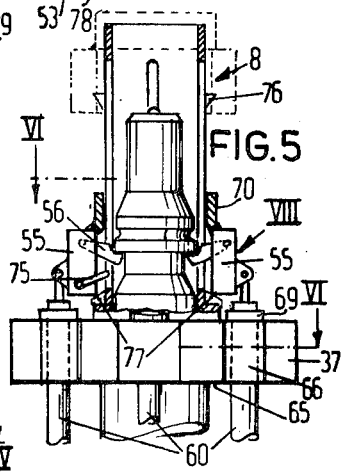
Figure 6:
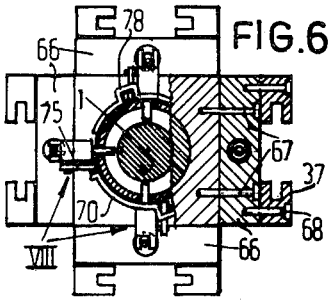
Figure 2:
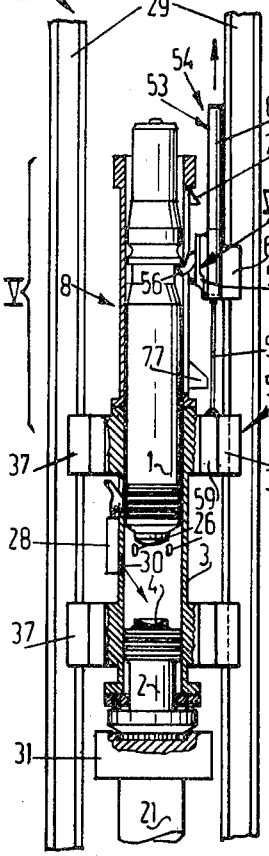
Figure 3:
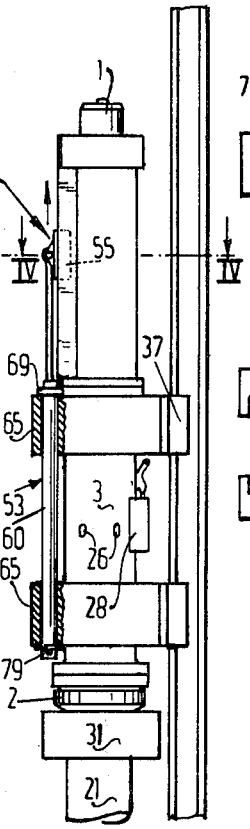
Figure 8:
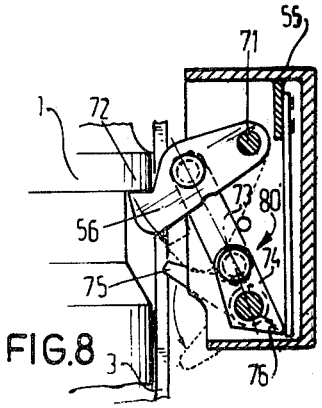

In the drawing show schematically:

FIG. 1 a survey of the operation of a pile-driving device in accordance with the invention, equipped with a Diesel hammer, FIG. 2 on an enlarged scale a vertical sectional view of a Diesel hammer as shown in FIG. 1, FIG. 3 a sectional view corresponding with that of FIG. 2 of a further pile-driving device in accordance with the invention, FIG. 4 a sectional view taken on the line IV—IV in FIG. 3, FIG. 5 a detail corresponding with the detail V of FIG. 2 of a further development of the pile-driving device in accordance with the invention, FIG. 6 a sectional view taken on the line VI—VI in FIG. 5, FIG. 7 a sectional view like FIG. 6 of a further pile-driving device in accordance with the invention and FIG. 8 on an enlarged scale a sectional view of the detail VIII in FIGS. 2 to 7.

By means of a floating derrick 24 a pile-driving device 27 is arranged on a pile 21 to be driven into a ground 23 beneath the water 22. This pile-driving device 27 comprises a guide frame 35 formed by a socket 25 surrounding the pile 21 and two guide stays 29 secured thereto. The pile-driving device 27 comprises furthermore a hammer 8, formed by a Diesel hammer, guided by guide members 37 along the guide stays 29 and a cap 31 bearing on the pile 21.

It will be apparent from FIG. 2 that the Diesel hammer 8 comprises a combustion cylinder 3, a hammer piston 1 operating as a hammer therein and a striker 2 bearing on the cap 31 and extending into the combustion cylinder 3. The combustion cylinder 3 has ports 26 for admitting air and conducting away exhaust gases and an injection nozzle 30 communicating with a fuel pump 28 and spraying fuel onto an impact surface 4 of the striker 2. When the hammer piston 1 strikes the striker 2, the fuel is atomized and after mixing with compressed air it ignites and burns so that the hammer piston 1 is again lifted. In order to start the Diesel hammer 8 each of them comprises in accordance with the invention lifting means 54 comprising a hydraulic cylinder-piston set 53, which is connected on the one hand with a support 55 of a catch 56 engaging the hammer piston 1 and on the other hand with the combustion cylinder 3. The cylinder-piston set 53 (see FIG. 2) engages, by means of a piston rod 57, spacers 59 forming part of the guide means 58 and arranged between the combustion cylinder 3 and the guide members 37.

FIG. 2 shows that the support 55 is rigidly connected with the cylinder 60 of the hydraulic cylinder-piston set 53; this cylinder 60 and hence the support 55 are guided by means of guide members 61 with respect to a guide stay 29. The cylinder 60 is energized through a duct system 62 from a hydraulic system 63 arranged on the derrick 24.

The support 55 is preferably guided with respect to the combustion cylinder 3. For this purpose, as is shown in FIG. 3, the support 55 is guided along rails 64 secured to the combustion cylinder 3. The piston rod 57 is connected with the support 55, whereas the piston 1 is secured to belts 65 of the combustion cylinder 3.

In the further development of the Deisel hammer 8 shown in FIG. 5 the combustion cylinder 3 has square belts 65, to which four spacers 66 are secured by bolts 67. Thereto are secured guide members 37 by bolts 68. The four cylinders 60 have each a fixed collar 69 bearing on a spacer 66. The cylinder 60 extends across a spacer 66 and is secured in place by a safety pin 79 shown in FIG. 3. A cylinder 60 can be readily removed from a spacer 66.

FIG. 7 shows only two hydraulic cylinder-piston sets 53 instead of four. All supports 55 of FIG. 5 and also all supports 55 of FIG. 7 are welded to a ring 70 surrounding the combustion cylinder 3. The ring 70 constitutes the guide means guiding each support 55 with respect to the combustion cylinder 3. Since a plurality of catches 56 are distributed along the circumference of the hammer piston 1, the latter will not deflect with respect to the combustion cylinder 3 when it is elevated. Each catch 56 comprises a hook adapted to turn about a shaft 71 relatively to the support 55 and engaging beneath a collar 72 of the hammer piston 1 and being connected through a link 73 with an arm 74 of an angle-lever 80. The other arm 75 of the angle-lever 80 is located beyond the support 55 and abutts in the lowered position of the support 55 against a cam 77 of the combustion cylinder 3 in order to actuate the catch 56, which grips beneath the collar 72. In the elevated position of the support 55 the arm 75 abutts against a cam 76 of the combustion cylinder 3 in order to put the catch 56 out of operation. In order to allow the cam 76 to pass the ring 70 has bulging parts 78.

What I claim is:

1. In a diesel pile-driving device having at least one cylinder guide stay, and a diesel hammer consisting of a combustion cylinder, guide means for guiding the cylinder along said cylinder guide stay, a hammer piston operating in the combustion cylinder and a striker in the combustion cylinder for engagement by the hammer to transmit the blow of the hammer to a pile, the improvement comprising lifting means for elevating the hammer piston away from the striker in the first stroke of operation of the hammer without combustion in the cylinder, said lifting means comprising at least one catch support slidably mounted in said device with respect to said cylinder, catch means mounted in the support for engaging the piston through the combustion cylinder; and elevating means for lifting the support with respect to the cylinder for raising the piston therein, said elevating means including at least one hydraulic cylinder-piston set operatively connected between the catch support and the combustion cylinder for lifting the catch support with respect to the cylinder; said cylinder-piston set engaging the cylinder guide means guiding the combution cylinder with respect to at least one guide stay.

2. In a diesel pile-driving device having at least one cylinder guide stay, and a diesel hammer consisting of a combustion cylinder, guide means for guiding the cylinder along said cylinder guide stay, a hammer piston operating in the combustion cylinder and a striker in the combustion cylinder for engagement by the hammer to transmit the blow of the hammer to a pile, the improvement comprising lifting means for elevating the hammer piston away fom the striker in the first stroke of operation of the hammer without combustion in the cylinder, said lifting means comprising at least one catch support slidably mounted in said device with respect to said cylinder, catch means mounted in the support for engaging the piston through the combustion cylinder; and elevating means for lifting the support with respect to the cylinder for raising the piston therein, said elevating means including at least one hydraulic cylinder-piston set operatively connected between the catch support and the combustion cylinder for lifting the catch support with respect to the cylinder; said cylinder set engaging the cylinder guide means guiding the combustion cylinder with respect to at least one guide stay and wherein said guide means comprise spacers arranged between the combustion cylinder and the cylinder guide means guided along at least one guide stay and wherein the cylinder-piston set is secured to said spacers.

3. In a diesel pile-driving device having at least one cylinder guide stay, and a diesel hammer consisting of a combution cylinder, guide means for guiding the cylinder along said cylinder guide stay, a hammer piston operating in the combustion cylinder and a striker in the combustion cylinder for engagement by the hammer to transmit the blow of the hammer to a pile, the improvement comprising lifting means for elevating the hammer piston away from the striker in the first stroke of operation of the hammer without combustion in the cylinder, said lifting means comprising at least one catch support slidably mounted in said device with respect to said cylinder, catch means mounted in the support for engaging the piston through the combustion cylinder; and elevating means for lifting the support with respect to the cylinder for raising the piston therein, said elevating means including at least one hydraulic cylinder-piston set operatively connected between the catch support and the combustion cylinder for lifting the catch support with respect to the cylinder; and means mounted on said cylinder for operatively engaging and guiding the support with respect to the combustion cylinder.

4. A pile-driving device as claimed in claim 3 wherein said support guide means comprises a ring surrounding the combustion cylinder and being slidable with respect thereto; and said catch support being mounted on said ring.

5. A pile-driving device as claimed in claim 4, including a plurality of catch supports and a plurality of catches respectively mounted therein for engaging the hammer piston at areas distributed along the circumference of the piston.

6. A pile-driving device as claimed in claim 4 including a plurality of catch supports and a plurality of catches respectively mounted therein for engaging the hammer piston at areas distributed along the circumference of the piston, said catch supports being mounted on said ring in circumferentially spaced relation to each other.

7. In a pile-driving device having at least one cylinder guide stay, a hammer consisting of a cylinder, guide means for guiding the cylinder along the cylinder guide stay, a hammer operating in the cylinder, a striker in the cylinder for engagement by the hammer to transmit the blow of the hammer to a pile, a catch support; catch means mounted in the support for engaging the piston through the cylinder and elevating means for lifting the support with respect to the cylinder for raising the cylinder therein; the improvement comprising means mounted on said cylinder for operatively engaging and guiding the catch support with respect to the combustion cylinder; said support guide means comprising a ring surrounding the combustion cylinder and being slidable with respect thereto; and said catch support being mounted on said ring.

8. A pile-driving device as claimed in claim 7 including a plurality of catch supports and a plurality of catches respectively mounted therein for engaging the hammer piston at areas distributed along the circumference of the piston, said catch supports being mounted on said ring in circumferentially spaced relation to each other.

* * * * *